US005482810A

United States Patent [19]

Nakayama et al.

[11] Patent Number: 5,482,810

[45] Date of Patent: Jan. 9, 1996

[54] PROCESS FOR THE PRODUCTION OF AN ELECTROPHOTOGRAPHIC LITHOGRAPHIC PRINTING PLATE PRECURSOR

[75] Inventors: Takao Nakayama; Shigeyuki Dan; Ryosuke Iwashita; Saburo Umehara, all of Shizuoka, Japan

[73] Assignees: Fuji Photo Film Co., Ltd., Kanagawa; Tomoegawa Paper Co., Ltd., Tokyo, both of Japan

[21] Appl. No.: 151,001

[22] Filed: Nov. 12, 1993

[30] Foreign Application Priority Data

Nov. 13, 1992 [JP] Japan ..... 4-303635

[51] Int. Cl.[6] ..... G03G 13/26

[52] U.S. Cl. ..... 430/130; 430/49

[58] Field of Search ..... 430/49, 130

[56] References Cited

U.S. PATENT DOCUMENTS 3,861,922 1/1975 Minoda ..... 430/3

FOREIGN PATENT DOCUMENTS 1560975 3/1969 France .

56-012651 2/1981 Japan .

OTHER PUBLICATIONS

Patents Abstracts of Japan, P–604, Aug. 13, 1987, vol. 11, No. 248, JPA 62 054 274, "Electrophotographic Sensitive Body".

Patents Abstracts of Japan, P–1411, Aug. 27, 1992, vol. 16, No. 407, JPA 04 136 946, "Method and Apparatus for Manufacturing OPC Photosensitive Drum".

*Primary Examiner*—John Goodrow

*Attorney, Agent, or Firm*—Sughrue, Mion, Zinn, Macpeak & Seas

[57] ABSTRACT

An excellent electrophotographic lithographic printing plate precursor capable of exhibiting a stable electrophotographic sensitivity and toner fogging density as well as less occurrence of background stains during printing can be produced in effective manner. The feature consists in a process for the production of an electrophotographic lithographic printing plate precursor having at least a photoconductive layer on a support, comprising coating a composition for a photoconductive layer comprising, as predominant components, a photoconductive material and a resin binder onto the support and then drying it by a drying air whose humidity is controlled to provide an absolute humidity of 5 to 70 g/kg . dried air.

8 Claims, No Drawings

PROCESS FOR THE PRODUCTION OF AN ELECTROPHOTOGRAPHIC LITHOGRAPHIC PRINTING PLATE PRECURSOR

BACKGROUND OF THE INVENTION

1. Field of the Invention

This invention relates to a process for the production of an electrophotographic lithographic printing plate precursor.

2. Description of the Prior Art

A process for the production of a lithographic printing plate by an electrophotographic method has been known, for example, which comprises subjecting a photoconductive layer of an electrophotographic plate making material such as electrophotographic lithographic printing plate precursors to uniform static charge, to imagewise exposure and then to development by wet or dry process to obtain a toner image, then fixing this toner image and processing it with an oil-desensitizing solution (etching solution) to render hydrophilic a non-image area apart from the toner image.

An electrophotographic lithographic printing plate precursor can generally be prepared by coating one surface of a support with a dispersion of a composition for a photoconductive layer comprising, as a predominant component, a photoconductive material, binder and dispersing liquid, drying and thus forming the photoconductive layer on the support. That is, the dispersion is coated onto the surface of the support and subjected to drying by drying air, ordinarily at 60° to 120° C., to evaporate the dispersing liquid, as the predominant component of the dispersion, for example, toluene, xylene or ethanol, thus forming the photoconductive layer. In spite of that the electrophotographic lithographic printing plate precursor has hitherto been prepared by determining the conditions of dispersing, coating and drying, the properties as an electrophotographic lithographic printing plate precursor, in particular, electrophotographic sensitivity, toner fogging density, background stains as a printing plate are unstable and it is difficult to maintain constant the sensitivity as electrophotographic properties and the printing adaptability as a printing plate.

SUMMARY OF THE INVENTION

It is an object of the present invention to provide an improved process for the production of an electrophotographic lithographic printing plate precursor, whereby disadvantages of the prior art can be overcome.

It is another object of the present invention to provide a process for the production of an excellent electrophotographic lithographic printing plate precursor capable of exhibiting a stable electrophotographic sensitivity and toner fogging density as well as less occurrence of background stains during printing.

These objects can be attained by a process for the production of an electrophotographic lithographic printing plate precursor having at least a photoconductive layer on a support, comprising coating a composition for a photoconductive layer comprising, as:predominant components, a photoconductive material and a resin binder onto the support and then drying it by a drying air whose humidity is controlled to provide an absolute humidity of 5 to 70 g/kg . dried air.

DETAILED DESCRIPTION OF THE INVENTION

The inventors have made various studies to overcome the foregoing difficulties of the prior art and consequently, have found that the electrophotographic properties such as sensitivity, toner fog, etc. and the printing property, such that background stains tend to occur during printing, largely depend on the absolute humidity;of drying air varying with periods of time over days or seasons.

It is further found that a stable sensitivity, low toner fog and printing property of less background stains can be maintained by controlling the absolute humidity. These properties can be realized by controlling the absolute humidity of drying air in a range of 5 to 70 g/kg . dried air. At an absolute humidity of lower than the lower limit, the sensitivity is lowered, the toner fog is increased and background staining during printing is remarkable, while at an absolute humidity of exceeding the upper limit, background staining is deteriorated or the surface strength is lowered because of occurrence of brushing. This is not preferable.

As a method of controlling the humidity of drying air in the present invention, specifically, in order to prevent change of the properties due to lowering of the environmental humidity in the winter season or due to lowering of the humidity caused by rapid change of the weather even in one day, coating and drying of a composition for a photoconductive layer for a long time are carried out by always adjusting the absolute humidity to a predetermined value in a range of 5 to 70 g/kg . dried air, preferably 15 to 60 g/kg . dried air using a humidifier during production of an electrophotographic lithographic printing plate precursor. More specifically, (1) humidifying is carried out correspondingly to when the absolute humidity in the open air is lower than 5 g/kg . dried air to maintain the absolute humidity to be aimed at a predetermined value in a range of 5 to 70 g/kg . dried air. When exceeding 70 g/kg . dried air, a humidifying control apparatus is stopped to restore it to a predetermined value in a range of 5 to 70 g/kg . dried air. (2) Even in a case where a rapid fluctuation of the humidity takes place, for example, the weather is changed in one day, the absolute humidity of dried air is always maintained in a predetermined value in a range of 5 to 70 g/kg . dried air by the similar control of the humidity.

Since the stability of the properties is more improved when the control range of the absolute humidity is narrower, of course, it is natural that the control of the absolute humidity is carried out in a range of providing better properties, being as narrower as possible even in a range of 5 to 70 g/kg . dried air.

Generally, it is not easy to operate a humidifying installation in stable manner for a long time when effecting very slight humidifying or effecting humidifying near the limit of the capacity of the humidifying installation, and accordingly, it is preferable to employ an absolute humidity range of 15 to 60 g/kg . dried air.

In addition, it is considered that provision of the aimed absolute humidity range by repeating "on" and "off" of a humidifying apparatus results in a large fluctuation of humidity by hunching, although depending upon the capacity of a control means. When a desired level is predetermined to at least the maximum absolute humidity in the open air through the year, therefore, the humidifying apparatus is always operated and the fluctuation of humidity by hunching can be reduced. Thus, an absolute humidity of 25 to 60 g/kg . dried air is more preferable.

When the process of the present invention is carried out in this way, there can be prepared an electrophotographic lithographic printing plate precursor capable of exhibiting stable electrophotographic properties not only in one day but also through the year having little tendency of background stains during printing.

Examples of the support used in the present invention include metals such as aluminum, zinc, copper, etc., basic papers having hitherto been used for electrophotographic light-sensitive materials, for example, papers impregnated with ionic conductive materials and electroconductive materials such as inorganic metal compounds, carbon, etc., as disclosed in U.S. Pat. No. 3,597,272 and French Patent No. 2,277,136 or mixed therewith during paper-making, synthetic papers as disclosed in Japanese Patent Publication Nos. 4239/1977, 19031/1978 and 19654/1978, and polyolefin-laminated papers obtained by adding an electroconductive material to one or both sides of the polyolefins, as described in Japanese Patent Laid-Open Publication No. 57994/1983.

Furthermore, a support itself or a surface of a support can substantially be rendered electroconductive, for example, by vapor depositing or laminating a metal such as aluminum, etc. or metal oxide such as indium oxide, tin oxide, etc. on an insulating film such as polyethylene terephthalate, polyvinyl chloride, cellulose acetate, etc., laminating thereon a polyolefin blended with carbon as disclosed in Japanese Patent Laid-Open Publication No. 57994/1983, or coating it with an electroconductive material such as CuI, thus imparting electroconductivity to the surface of a film surface.

The photoconductive layer provided on a support as described above consists of a photoconductive material and a binder. As the photoconductive material, there are used zinc oxide, cadmium sulfide, titanium oxide, etc. These photoconductive materials can be used individually or in combination, or in combination with organic photoconductive materials. As the binder, there are used silicone resins, polystyrene, polyacrylic(methacrylic) acid esters, polyvinyl acetate, polyvinyl chloride, polyvinyl butyral and derivatives thereof.

The photoconductive material and the binder are preferably used in a proportion by weight of 3: 1 to 20: 1. If necessary, sensitizers or coating aids can be added thereto.

As a liquid for dispersion, there can be used suitable liquids, well known in the art, for example, toluene, xylene, ethanol, etc.

The above described photoconductive layer is provided on the above described support, during which the surface of the support can preferably be subjected to a previous surface treatment such as treatments by corona discharge as described in U.S. Pat. No. 3,411,908, glow discharge, flame, ultraviolet rays, ozone, plasma, etc. so as to improve the bonding strength with the photoconductive layer. The thus provided photoconductive layer has preferably a thickness of 5 to 30 μm.

In the present invention, an intermediate layer can further be provided between the above described support and photoconductive layer. A resin used for the intermediate layer is not particularly limited, but can be selected from, for example, polyethylene terephthalate, polyimide, polycarbonate, polyacrylate, polymethyl methacrylate, polyvinyl fluoride, polyvinyl chloride, polyvinyl acetate, polystyrene, styrene-butadiene copolymer, polymethacrylate, silicone resins, chloride rubbers, epoxy resins, pure and modified alkyd resins, polyethyl methacrylate, poly-n-butyl methacrylate, cellulose acetate, ketone resins, polyethylene, polypropylene, polyacrylonitrile, rosin derivatives, polyvinylidene chloride, nitrocellulose, phenol-formaldehyde resins, m-cresol-formaldehyde reins, styrene-maleic anhydride copolymers, polyacrylic acid-polyacrylic acid amide copolymers, fumaric acid-ethylene glycol copolymers, methyl vinyl ether-maleic anhydride copolymers, polyvinylpyrrolidone, polyvinyl alcohol, polyamide, styrene halide and the like. The coating amount of the intermediate layer is preferably in the range of 0.01 to 10 g/m$^2$. If necessary, the polymer of the intermediate layer can contain an electroconductive salt.

Formation of the photoconductive layer is specifically carried out by dispersing a composition for a photoconductive layer comprising, as predominant components, a photoconductive material, binder and dispersing liquid by means of, for example, a homogenizer, ultrasonic dispersing device, ball mill, colloid mill, three-roll mill, grain mill, homomixer, Kedy mill, etc. to prepare a dispersion, coating the dispersion onto the surface of a support by means of, for example, an air knife coater, trailing grade coater, wire bar coater, reverse roll coater, kiss roll coater, fountain coater, etc. and then drying, as described above, by drying air in the range of an absolute humidity of 5 to 70 g/kg . dried air.

Preparation of a lithographic printing plate using an electrophotographic printing plate-making material of the present invention can be carried out by the commonly used method, for example, by subjecting a photoconductive layer to uniform static charge by a corona discharge method, then to imagewise exposure to form an imagewise statically charged image, toner developing by wet or dry process and fixing the resulting image by heating or other means. Then, the non-image area free from adhesion of the toner is processed with a oil-desensitizing solution to render it hydrophilic. Examples of the oil-desensitizing solution include, for example, compositions containing ferrocyanide or ferricyanide compounds as disclosed in U.S. Pat. No. 4,116,698 and compositions containing metal complex salts as disclosed in U.S. Pat. No. 4,282,811.

The present invention will now be illustrated in detail by the following examples without limiting the same. In these Examples, "%" and "parts" are to be taken as those by weight unless otherwise indicated.

Raw materials shown in Table 1 were mixed and dispersed by a homogenizer at 7000 rpm for 10 minutes to prepare a coating composition for a photoconductive layer.

TABLE 1

| Coating Composition for Photoconductive Layer | parts |
|---|---|
| Photoconductive Zinc Oxide (Sazex 2000 -commercial name- made by Sakai Kagaku KK) | 100 |
| Acrylic Resin (Dianal LR 018 -commercial name- made by Mitsubishi Rayon KK) | 20 |
| Rose Bengal | 0.1 |
| Fluorescein | 0.2 |
| Methanol | 10 |
| Toluene | 150 |

In the following examples, the proper sensitivity means such an exposing condition that an area having a reflection density of a step wedge of 0.57 in a manuscript gives a reflection density of 0.5 on a print.

The absolute humidity is sought by measuring the temperature and humidity under the experimental atmosphere using a hygrothermometer of high temperature type and reading this as an absolute humidity from the enthalpy-humidity chart.

Example 1

A coating composition of the above described Table 1 was coated onto an electrophotographic paper base for a lithographic printing plate, having water resisting property, to provide a dry coverage of 25 g/m$^2$, and dried for 20 seconds in a coating machine of small size in which the outside air was taken, heated and used as drying air, to thus prepare Sample No. 1 for comparison. The drying temperature was 110° C. The outside air had a temperature of 6° C. and a humidity of 46% RH. The absolute humidities of the outside air and a drying part (oven) of the coating machine were both 2.7 g/kg . dried air.

The estimation method of the background stains during printing was carried out by pre-etching a sample with 1 part of an etching solution (ELP-E2, —commercial name— manufactured by Fuji Photo Film Co.) diluted with 10 parts of water, subjecting it to printing using, as a dampening water for printing, 1 part of the same etching solution ELP-E2 diluted with 5 parts of water and then measuring the reflection density OD of the printing stain of a 100th print by means of Macbeth reflection densitometer. The printing was carried out using an automatic printing machine (Ryobi AD 80 —commercial name— manufactured by Ryobi KK) and an ink (F 6loss (Black)—commercial name— manufactured by Dai-Nippon Ink KK). The environmental atmosphere during coating and drying, absolute humidity in the oven maintained at 110° C. and controlled by humidifying, estimation results of background stains and using or non-using of forced humidifying are tabulated below:

TABLE 2

| Sample No. | Environmental Atmosphere | Absolute Humidity in Oven (g/kg . dried air) | Proper Sensitivity (sec) | Fogging (OD) | Background Stains (OD) | Forced Humidifying |
|---|---|---|---|---|---|---|
| 1 | 6° C./46% RH | 2.7 | 9.3 | 0.15 | 0.35 | no |
| 2 | " | 13.0 | 8.8 | 0.09 | 0.03 | yes |
| 3 | " | 31.0 | 8.5 | 0.08 | 0.00 | yes |
| 4 | " | 65.2 | 8.5 | 0.08 | 0.00 | yes |

In the similar manner to Sample No. 1, the coating composition of Table 1 was coated onto the electrophotographic paper base and dried for 20 seconds in a coating machine using steam to humidify the drying air by controlling the pressure of a steam valve to adjust the temperature in an oven thereof to 110° C. same as in the case of Sample No. 1 and the absolute humidity to 13.0 g/kg . dried air, 31.0 g/kg . dried air and 65.2 g/kg . dried air, thus obtaining respectively Sample Nos. 2 to 4 (Article of Present Invention).

Each of the thus obtained Sample Nos. 1 to 4 was subjected to plate making using an electrophotographic printing plate making machine ELP-404V (commercial name, manufactured by Fuji Photo Film Co.), during which a proper exposure time and fogging density of non-image area were examined by Macbeth reflection densitometer. Background stain was also estimated as printing adaptability.

Example 2

A coating composition of Table 1 was prepared in an analogous manner to Example 1, coated onto an electrophotographic paper base and dried in a drying part (oven) of the same drying machine, during which the outside air was at 18° C. and 51% RH and the absolute humidities of the outside air and in the oven were respectively 7.8 g/kg . dried air and 7.3 g/kg. dried air, thus obtaining Sample No. 5.

The dispersion of Table 1 was similarly prepared, coated onto an electrophotographic paper base (outside air 18° C., 51% RH, absolute humidity 7.8 g/kg . dried air) and dried for 20 seconds in the oven by controlling, under this state, the pressure of a valve for feeding steam to adjust the temperature in the oven to 110° C. and the absolute humidity to 39.2 g/kg . dried air and 75.3 g/kg . dried air, thus obtaining respectively Sample Nos. 6 and 7.

As to Sample Nos. 5 and 6 (present invention) and Sample No. 7 (comparison), the measurements of the proper exposure time and fogging density of non-image areas and the estimation of background stains were carried out in an analogous manner to Example 1 to obtain results as shown in Table 3:

TABLE 3

| Sample No. | Environmental Atmosphere | Absolute Humidity in Oven (g/kg . dried air) | Proper Sensitivity (sec) | Fogging (OD) | Background Stains (OD) | Forced Humidifying |
|---|---|---|---|---|---|---|
| 5 | 18° C./51% RH | 7.3 | 8.7 | 0.10 | 0.07 | no |
| 6 | " | 39.2 | 8.5 | 0.08 | 0.00 | yes |

TABLE 3-continued

| Sample No. | Environ-mental Atmosphere | Absolute Humidity in Oven (g/kg . dried air) | Proper Sensitivity (sec) | Fogging (OD) | Background Stains (OD) | Forced Humidifying |
|---|---|---|---|---|---|---|
| 7 | " | 75.3 | 9.1 | 0.13 | 0.12 | yes |

Example 3

A coating composition of Table 1 was prepared in an analogous manner to Example 1, coated onto an electrophotographic paper base and dried in a drying part (oven) of the same drying machine, during which the outside air was at 29° C. and 92% RH and the absolute humidities of the outside air and in the oven were substantially the same, 23.0 g/kg . dried air, thus obtaining Sample No. 8.

The coating composition of Table 1 was similarly prepared, coated onto an electrophotographic paper base (outside air 29° C., 92% RH, absolute humidity 23.0 g/kg . dried air) and dried for 20 seconds in the oven by controlling, under this state, the pressure of a valve for feeding steam to adjust the temperature in the oven to 110° C. and the absolute humidity to 48.7 g/kg . dried air and 69.5 g/kg . dried air, thus obtaining respectively Sample Nos. 9 and 10.

As to Sample Nos. 8 to 10 (present invention), the measurements of the proper exposure time and fogging density of non-image areas and the estimation of background stains were carried out in an analogous manner to Example 1 to obtain results as shown in Table 4:

TABLE 4

| Sample No. | Environ-mental Atmosphere | Absolute Humidity in Oven (g/kg . dried air) | Proper Sensitivity (sec) | Fogging (OD) | Background Stains (OD) | Forced Humidifying |
|---|---|---|---|---|---|---|
| 8 | 29° C./92% RH | 23.5 | 8.5 | 0.08 | 0.00 | no |
| 9 | " | 48.7 | 8.5 | 0.08 | 0.00 | yes |
| 10 | " | 69.5 | 8.7 | 0.09 | 0.03 | yes |

As is apparent from the foregoing Examples, the proper sensitivity of the electrophotographic lithographic printing plate precursor obtained by drying with drying air whose humidity is controlled to give an absolute humidity of 5 to 70 g/kg . dried air is stable, i.e. in the range of 8.5 to 8.8 sec. Outside the humidity range, the sensitivity is markedly lowered. Furthermore, within the range of the absolute humidity, the fogging density is stable and low, i.e. in the range of 0.08 to 0.10. The experimental results on the printing stains tell that within the above described range of the absolute humidity, the reflection density (OD value) is at most 0.10, which is considered to be satisfactory on practical use, while outside the range of the absolute humidity, the OD value exceeds 0.10, resulting in tendency of occurrence of background stains.

Therefore, the limitation of the absolute humidity of drying air is found significant in the present invention.

Advantages of Present Invention

According to the present invention, an excellent electrophotographic lithographic printing plate precursor capable of exhibiting a stable electrophotographic sensitivity and toner fogging density as well as less occurrence of background stains during printing can be produced in effective manner.

What is claimed is:

1. A process for the production of an electrophotographic lithographic printing plate precursor having at least a photoconductive layer on a support, comprising coating a composition for a photoconductive layer comprising, as predominant components, a photoconductive material and a resin binder onto the support and then drying the coated composition with a drying air whose humidity is controlled to provide an absolute humidity of 5 to 70 g/kg . dried air.

2. The process for the production of an electrophotographic lithographic printing plate precursor having at-least a photoconductive layer on a support, as claimed in claim 1, wherein the humidity is controlled by effecting humidifying when the absolute humidity of the outside air is lower than 5 g/kg . dried air.

3. The process for the production of an electrophotographic lithographic printing plate precursor having at least a photoconductive layer on a support, as claimed in claim 1, wherein the humidity is controlled by stopping a humidifying control apparatus when the absolute humidity of the outside air exceeds 70 g/kg . dried air.

4. The process for the production of an electrophotographic lithographic printing plate precursor having at least a photoconductive layer on a support, as claimed in claim 1, wherein the support is selected from the group consisting of metals, paper bases impregnated with electroconductive materials or blended with electroconductive materials during paper making, paper bases laminated with polyolefins to one or both sides of which electroconductive materials are added and insulating films vapor deposited or laminated with metal oxides, laminated with polyolefin films blended with carbon and coated with electroconductive materials.

5. The process for the production of an electrophotographic lithographic printing plate precursor having at least a photoconductive layer on a support, as claimed in claim 1, wherein the photoconductive layer consists of a photoconductive material and a binder.

6. The process for the production of an electrophotographic lithographic printing plate precursor having at least a photoconductive layer on a support, as claimed in claim 5, wherein the photoconductive material is at least one member selected from the group consisting of zinc oxide, cadmium sulfide and titanium oxide.

7. The process for the production of an electrophotographic lithographic printing plate precursor having at least a photoconductive layer on a support, as claimed in claim 5, wherein the binder is at least one member selected from the group consisting of silicone resins, polystyrene, polyacrylic(methacrylic) acid esters, polyvinyl acetate, polyvinyl chloride, polyvinyl butyral and derivatives thereof.

8. The process for the production of an electrophotographic lithographic printing plate precursor having at least a photoconductive layer on a support, as claimed in claim 5, wherein the photoconductive material and binder are present in a proportion by weight of 3: 1 to 20: 1.

* * * * *